US012429229B2

(12) United States Patent
Farrel

(10) Patent No.: US 12,429,229 B2
(45) Date of Patent: Sep. 30, 2025

(54) LOCATING FEATURES FOR A FRONT PANEL OF A DOMESTIC APPLIANCE DOOR

(71) Applicant: Haier US Appliance Solutions, Inc., Wilmington, DE (US)

(72) Inventor: Caleb Farrel, Jeffersonville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 431 days.

(21) Appl. No.: 17/983,104

(22) Filed: Nov. 8, 2022

(65) Prior Publication Data

US 2024/0151405 A1 May 9, 2024

(51) Int. Cl.
*F24C 15/04* (2006.01)
*F24C 15/02* (2006.01)

(52) U.S. Cl.
CPC ..... *F24C 15/04* (2013.01); *F24C 15/024* (2013.01)

(58) Field of Classification Search
CPC ..... F24C 15/04; F24C 15/024
USPC ..... 126/200
See application file for complete search history.

(56) References Cited

U.S. PATENT DOCUMENTS 1,496,916 A * 6/1924 Whittam ..... E06B 3/56 52/204.705
4,134,238 A * 1/1979 Auger ..... E06B 3/5409 52/656.5
5,819,722 A * 10/1998 Katz ..... F24C 15/006 126/200
2007/0204847 A1 9/2007 Lee et al.
2022/0299253 A1* 9/2022 Fulgham, Jr. ..... F25D 23/028

FOREIGN PATENT DOCUMENTS

| | | | | |
|---|---|---|---|---|
| CN | 1455183 A | | 11/2003 | |
| CN | 204120850 U | * | 1/2015 | ..... A47J 37/06 |
| JP | S5893708 U | * | 6/1983 | ..... F24C 15/04 |
| JP | 2003336852 A | * | 11/2003 | ..... H05B 6/6414 |
| JP | 4545102 B2 | * | 9/2010 | ..... H05B 6/6414 |
| KR | 100700769 B1 | | 3/2007 | |

OTHER PUBLICATIONS

Chinese to English machine translation of CN_204120850_U (Year: 2015).*
Japanese to English machine translation of JP2003336852A (Year: 2003).*
Japanese to English machine translation of JP4545102B2 (Year: 2010).*
Japanese to English machine translation of JPS5893708U (Year: 1983).*

* cited by examiner

*Primary Examiner* — Michael G Hoang
*Assistant Examiner* — Elizabeth Ann Laughlin
(74) *Attorney, Agent, or Firm* — Dority & Manning, P.A.

(57) ABSTRACT

A door assembly for a domestic appliance includes a support frame including at least one trim piece directed away from the receiving space along the transverse direction; a front glass panel selectively mounted to the support frame between the at least one trim piece and the receiving space, the front glass panel comprising a top edge; and a handle assembly attached to the at least one trim piece opposite the front glass panel. The handle assembly includes a pair of tabs protruding through the at least one trim piece toward the receiving space along the transverse direction. The pair of tabs engage the top edge of the front glass panel along the vertical direction.

20 Claims, 6 Drawing Sheets

LOCATING FEATURES FOR A FRONT PANEL OF A DOMESTIC APPLIANCE DOOR

FIELD OF THE INVENTION

The present subject matter relates generally to domestic appliances, and more particularly to locating features for aligning a front panel in a door assembly of an oven door.

BACKGROUND OF THE INVENTION

Conventional residential and commercial oven appliances generally include a cabinet that defines a cooking chamber for receipt of food items for cooking. Multiple gas or electric heating elements may be positioned within the cabinet for heating the cooking chamber to cook food items located therein. The heating elements can include, for example, a bake heating assembly positioned at a bottom of the cooking chamber and a separate broiler heating assembly positioned at a top of the cooking chamber. A door or door assembly is often provided to selectively cover the opening to the cooking chamber. In some cases, multiple doors may be provided, such as to cover separate cooking chambers defined by the cabinet.

In common oven appliances, a glass (e.g., transparent ceramic or glass ceramic) panel is included with the door to permit a user to see through the door and into the corresponding cooking chamber. Typically, such panels are disposed on a frame that forms a circumferential bezel that defines an enclosed hole that is covered by the glass panel. Together, the circumferential bezel and a portion of the glass panel may form the front or outer surface of the door. Assembling these glass panels may be difficult, as a particular location is required to ensure a proper seal along with acceptable fit and finish. Existing methods of positioning glass panels have several drawbacks, however. For instance, vertically locating a glass panel with respect to the frame can be difficult. Adding additional or dedicated pieces for locating a glass panel may generally add to the cost, complexity, and difficulty of assembling the door.

Accordingly, an oven appliance with one or more features to obviate one or more of the above-mentioned drawbacks would be beneficial. In particular, an assembly with features for easily or efficiently assembling glass panels on a door (e.g., of an oven appliance) would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a door assembly for a domestic appliance is provided. The domestic appliance may include a cabinet forming a receiving space. The door assembly may include a support frame including at least one trim piece directed away from the receiving space along the transverse direction; a front glass panel selectively mounted to the support frame between the at least one trim piece and the receiving space, the front glass panel including a top edge; and a handle assembly attached to the at least one trim piece opposite the front glass panel. The handle assembly may include a pair of tabs protruding through the at least one trim piece toward the receiving space along the transverse direction. The pair of tabs may engage the top edge of the front glass panel along the vertical direction.

In another exemplary aspect of the present disclosure, an oven appliance is provided. The oven appliance may include a cabinet defining a cooking chamber; and a door assembly movably mounted to the cabinet to selectively provide access to the cooking chamber. The door assembly may include a support frame including at least one trim piece directed away from the cooking chamber along the transverse direction; a front glass panel selectively mounted to the support frame between the at least one trim piece and the cooking chamber, the front glass panel including a top edge; and a handle assembly attached to the at least one trim piece opposite the front glass panel, the handle assembly including a pair of tabs protruding through the at least one trim piece toward the cooking chamber along the transverse direction. The pair of tabs may engage the top edge of the front glass panel along the vertical direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
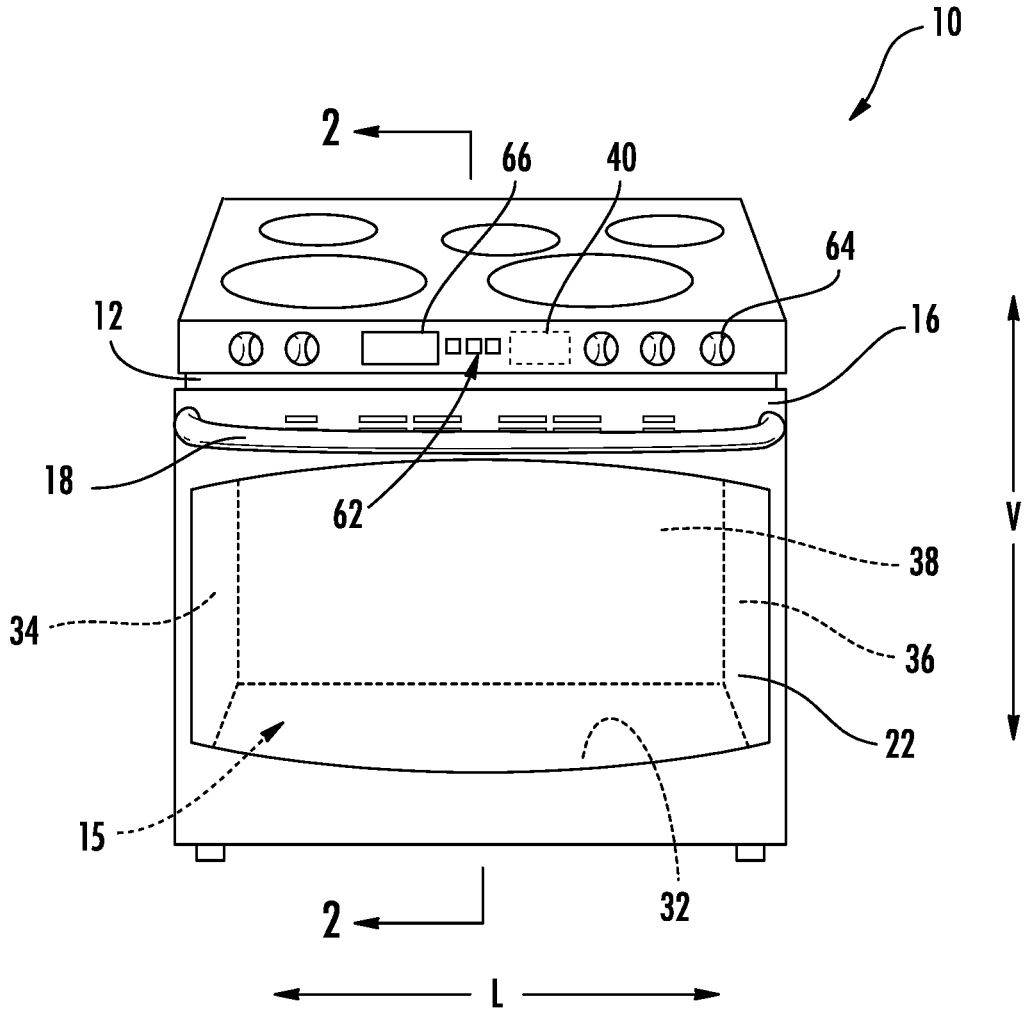
FIG. 1 provides a front perspective view of an oven appliance according to one or more example embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
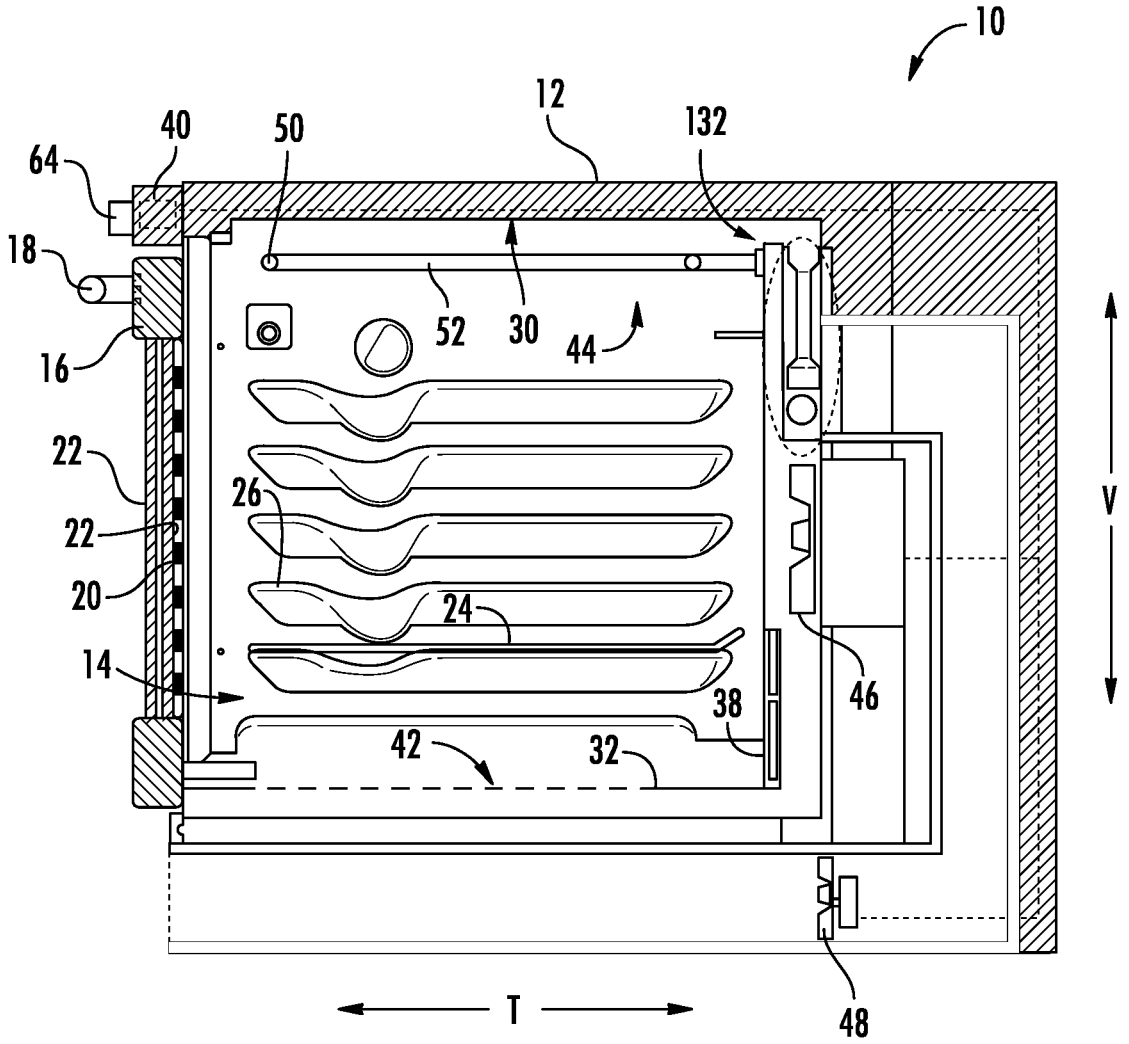
FIG. 2 provides a cross-sectional side view of the exemplary oven appliance of FIG. 1 taken along the line 2-2 of FIG. 1.

Turning now to the figures, FIGS. 1 and 2 provide views of an example oven appliance which may incorporate embodiments of the present subject matter. For instance, FIG. 1 provides a perspective view of an oven appliance 10 according to example embodiments of the present subject matter. FIG. 2 provides a section view of oven appliance 10 taken along the 2-2 line of FIG. 1. Oven appliance 10 may define a vertical direction V, a lateral direction L, and a transverse direction T. The vertical direction V, lateral direction L, and transverse direction T are mutually perpendicular and form an orthogonal direction system. As will be understood, oven appliance 10 is provided by way of example only, and the present subject matter may be used in any suitable domestic appliance (e.g., any suitable oven appliance). For example, the oven appliance may be a wall oven or a freestanding range that also includes a cooktop, as illustrated. As another example, the oven appliance may include multiple interior cavities that define multiple heating chambers in the oven appliance. Thus, the present subject matter may be used with other oven or range appliance configurations, e.g., that define multiple interior cavities for the receipt of food and/or having different configuration than what is shown in FIG. 2.

Oven appliance 10 includes an insulated cabinet 12 with an interior cooking chamber 14 defined by an interior surface 15 of cabinet 12. Cooking chamber 14 is configured for the receipt of one or more food items to be cooked. Oven appliance 10 includes a door 16 rotatably mounted to cabinet 12, e.g., with a hinge (not shown). A door handle 18 is mounted to door 16 and assists a user with opening and closing door 16 in order to access opening 20 to cooking chamber 14. For example, a user can pull on handle 18 to open or close door 16 and access cooking chamber 14 through front opening 20.

One or more glass panes 22 may allow for viewing the contents of cooking chamber 14 when door 16 is closed and assist with insulating cooking chamber 14. A baking rack 24 is positioned in cooking chamber 14 for the receipt of food items or utensils containing food items. Baking rack 24 is slidably received onto embossed ribs 26 or sliding rails such that rack 24 may be conveniently moved into and out of cooking chamber 14 when door 16 is open.

As shown, various walls define the cooking chamber 14. For example, cooking chamber 14 includes a top wall 30 and a bottom wall 32 which are spaced apart along the vertical direction V. Left sidewall 34 and right sidewall 36 (as defined according to a perspective front view as shown in FIG. 1, e.g., from the perspective of a user facing the oven appliance 10 to access/use the oven appliance 10 and/or cooking chamber 14) extend between the top wall 30 and bottom wall 32, and are spaced apart along the lateral direction L. A rear wall 38 additionally extends between the top wall 30 and bottom wall 32 as well as between the left sidewall 34 and right sidewall 36, and is spaced apart from the door 16 along the transverse direction T. Cooking chamber 14 is thus defined between the top wall 30, bottom wall 32, left sidewall 34, right sidewall 36, and rear wall 38.

Optionally, a lower heating assembly 42 may be included in oven appliance 10, e.g., for baking operations within cooking chamber 14. Lower heating assembly 42 may include a discrete heating element (not pictured) which is disposed within the cooking chamber 14, such as adjacent to the bottom wall 32. In some embodiments, the lower heating assembly 42 includes a gas burner. Additional components, such as an igniter and a fuel line may be provided in some such embodiments. Alternatively, the lower heating assembly 42 may include an electric heating element or may be any other suitable bake assembly having any other suitable heating element.

An upper heating assembly, such as a broiler assembly 44, may be included in oven appliance 10. Broiler assembly 44 includes a convection heating element 50 and a radiant heating element 52. The radiant heating element 52 may be an electric heating element, such as a resistive heating rod as illustrated in FIG. 2. The convection components of broiler assembly 44 include one or more air handlers 46, 48, e.g., fans or blowers, and a convection heating element 50. As illustrated, convection heating element 50 is generally positioned away from cooking chamber 14 such that convection heat (and not radiation heat) is received in cooking chamber 14 from convection heating element 50. Convection heating element 50 may be an electric heating element, such as a resistive heating rod, or a gas burner configured to generate a heated gas for cooking operations. Air handler(s) 46, 48 may be in fluid communication with convection heating element 50 to motivate heated gas from the convection heating element 50 and through a broil outlet 132 into the cooking chamber 14. Broil outlet 132 may be provided at or proximate to a top portion of the cooking chamber 14, e.g., at the top wall 30, such as at or proximate to an intersection of the top wall 30 with the rear wall 38. Moreover, during certain operations, broil outlet 132 may be downstream from air handler(s) 46, 48 and convection heating element 50 to receive a heated gas therefrom.

Oven appliance 10 may further include a controller 40, e.g., configured to control one or more operations of the oven appliance 10. For example, controller 40 may control at least one operation of oven appliance 10 that includes broiler assembly 44. Controller 40 may be in communication (via for example a suitable wired or wireless connection) with the heating elements 50 and 52 as well as other suitable components of the oven appliance 10, as discussed herein. In general, controller 40 may be operable to configure the oven appliance 10 (and various components thereof) for cooking. Such configuration may be based, for instance, on a plurality of cooking factors of a selected operating cycle or mode.

By way of example, controller 40 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 40 may be positioned in a variety of locations throughout oven appliance 10. As illustrated, controller 40 may be located within a user interface panel 62 of oven appliance 10 as shown in FIGS. 1 and 2. In some such embodiments, input/output ("I/O") signals may be routed between controller 40 and various operational components of oven appliance 10, such as convection heating element 50, radiant heating element 52, air handler(s) 46, 48, controls 64, display component 66, sensors, alarms, and/or other components as may be provided. For instance, signals may be directed along one or more wiring harnesses that may be routed through cabinet 12. In some embodiments, controller 40 is in communication with user interface panel 62 and controls 64 through which a user may select various operational features and modes and monitor progress of oven appliance 10. In one embodiment, user interface panel 62 may represent a general purpose I/O ("GPIO") device or functional block. In one embodiment, user interface panel 62 may include input components, such as one or more of a variety of electrical, mechanical or electro-mechanical input devices including rotary dials, push buttons, and touch pads. User interface panel 62 may include a display component 66, such as a digital or analog display configured to provide operational feedback to a user.

Although the described embodiment of FIGS. 1 and 2 are directed to an oven appliance 10 in which the user interface panel 62 and controls 64 are aligned with the top of cabinet 12, it should be recognized that the present disclosure is not so limited. For example, alternative oven appliance designs may also fall within the scope of the present disclosure, for example, wherein the user interface panel and controls are located behind and above the cooktop or wherein more, fewer, and different types and/or arrangements of heating elements are present.

Figure 3:
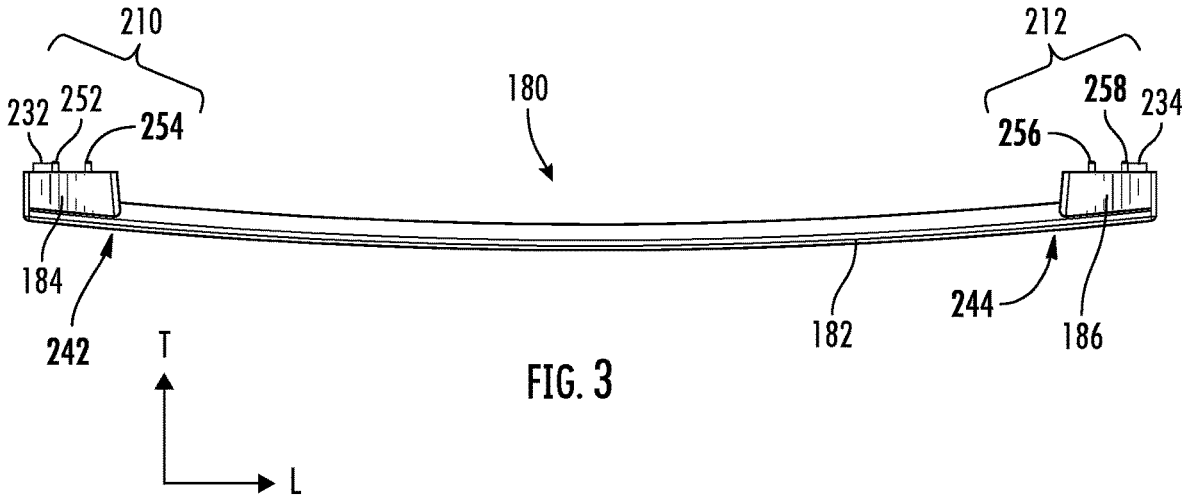
FIG. 3 provides a top view of a door handle according to one or more exemplary embodiments of present disclosure.

Referring now to FIG. 3, a top view of an exemplary door handle 18 is provided. Door handle 18 may include a first end 242 and a second end 244. In the embodiment of FIG. 3, the first end 242 of door handle 18 may include a pair of locating pins 210 including a first outer locating pin 252 and a first inner locating pin 254, both extending from door handle 18 in the direction of cabinet 12 (e.g., when the corresponding door is in the closed position). The first outer locating pin 252 and the first inner locating pin 254 may be spaced apart from each other along the horizontal or lateral direction. Additionally or alternatively, in some embodiments, first outer locating pin 252 and first inner locating pin 254 may be spaced apart along the vertical direction.

Likewise, in the embodiment of FIG. 3, the second end 244 of door handle 18 may include a pair of locating pins 212 including a second inner locating pin 256 and a second outer locating pin 258, both extending from door handle 18 in the direction of cabinet 12. The second outer locating pin 258 and the second inner locating pin 256 may be spaced apart from each other along the horizontal or lateral direction. Additionally or alternatively, in some embodiments, second outer locating pin 258 and second inner locating pin 256 may be spaced apart along the vertical direction. As will be explained in further detail below, door handle 18 may include a pair of tabs 230 extending from door handle 18 in the direction of cabinet 12 (e.g., parallel with the locating pins). The pair of tabs 230 may be provided at each of first end 242 and second end 244 of door handle 18. The pair of tabs 230 may include a first tab 232 provided at first end 242 of handle 18, and a second tab 234 provided at second end 244 of handle 18. Each of first tab 232 and second tab 234 will be explained in more detail below.

According to some embodiments, handle 18 is a handle assembly 180. For instance, handle assembly 180 may include a handlebar 182 and a pair of endcaps including a first endcap 184 and a second endcap 186. According to this embodiment, the first outer locating pin 252, first inner locating pin 254, and first tab 232 may protrude or extend from first endcap 184. Similarly, second outer locating pin 258, second inner locating pin 256, and second tab 234 may protrude or extend from second endcap 186. Additionally or alternatively, a fastening hole 190 may be defined within each of first endcap 184 and second endcap 186. The fastening holes 190 may be respectively positioned between first outer locating pin 252 and first inner locating pin 254, and between second outer locating pin 258 and second inner locating pin 256 along the lateral direction L. Accordingly, a fastener (e.g., a screw, a bolt, a rivet, etc.) may be provided through the fastening hole 190 to attach handlebar 182 to each of first endcap 184 and second endcap 186. Additionally or alternatively, the fastener may fasten handle assembly 180 to support frame 202 (e.g., upper trim piece 220).

Figure 4:
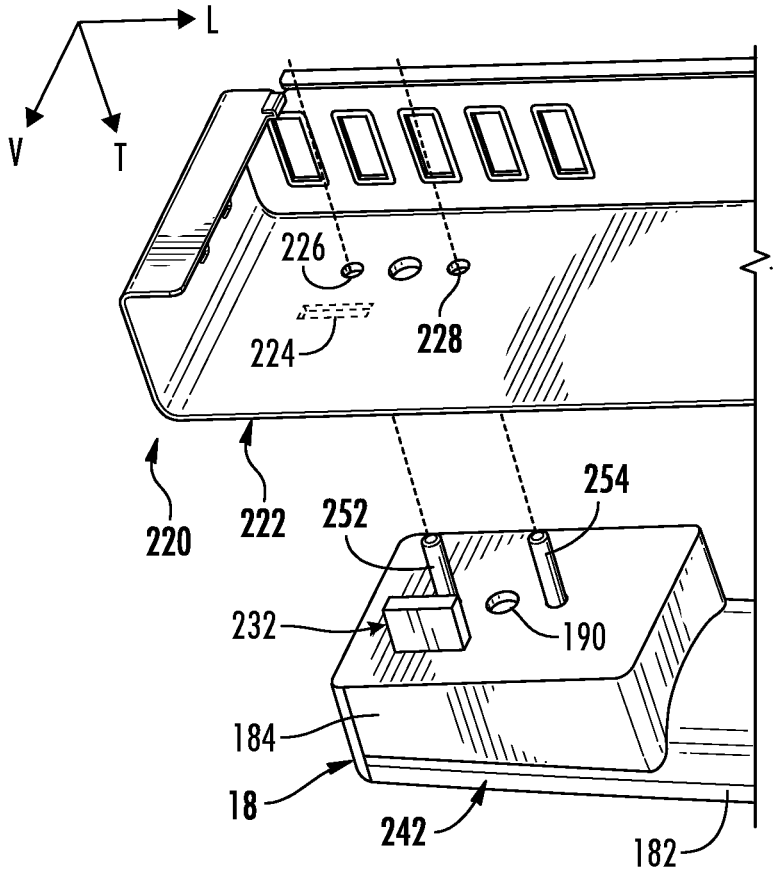
FIG. 4 provides a perspective view of the relationship between a door handle, door trim, and handle bracket according to one or more exemplary embodiments of present disclosure.

FIGS. 4 through 8 provide various views of a relationship between the door handle 18, a support frame 202, and a front glass panel 204. For instance, oven appliance 10 may include a door assembly 200. Door assembly 200 may include, for instance, support frame 202 and a front glass panel 204 mounted to support frame 202. Support frame 202 may include one or more trim pieces 220 surrounding front glass panel 204. For instance, an upper trim piece 220 may be located at or near a top of door assembly 200 (e.g., when door 16 is in a closed position relative to cooking chamber 14). In some embodiments, support frame 202 includes a lower trim piece in addition to upper trim piece 220. In still further embodiments, support frame 202 include lateral side trim pieces in addition to upper trim piece 220 and the lower trim piece. In particular, FIG. 4 provides a close-up view of an interaction between handle 18 and upper trim piece 220.

In this embodiment, the first outer locating pin 252 extends from the door handle 18 and through an outer opening 226 of a first end 222 of upper trim piece 220. For instance, first outer locating pin 252 penetrates upper trim piece 220 along the transverse direction T (e.g., when door 16 is in the closed position) toward cooking chamber 14. Similarly, first inner locating pin 254 may extend from door handle 18 through an outer opening 228 of first end 222 of upper trim piece 220 (e.g., parallel with first outer locating pin 252). Advantageously, first outer locating pin 252 and first inner locating pin 254 may assist in locating handle 18 with respect to support frame 202 (e.g., upper trim piece 220) and without requiring a separate or dedicated locating member. Although not specifically shown, it should be understood that second outer locating pin 258 and second inner locating pin 256 provided at second end 244 of handle 18 may extend through upper trim piece 220 in a similar manner.

First tab 232 may extend through a tab opening 224 defined in upper trim piece 220. In detail, tab opening 224 may be located beneath outer opening 226 (e.g., along the vertical direction V when door 16 is in the closed position). Tab opening 224 may be provided a first predetermined distance away from outer opening 226 (e.g., notably ensuring or enhancing the structural integrity of upper trim piece 220). Additionally or alternatively, tab opening 224 may be provided a second predetermined distance away from a lateral edge of upper trim piece 220. Tab opening 224 may be elongated along the lateral direction L. For instance, tab opening 224 may have a length along the lateral direction L that is greater than a height along the vertical direction V (e.g., when door 16 is in the closed position). Tab opening 224 may be defined through upper trim piece 220 along the transverse direction T (e.g., when door 16 is in the closed position).

First tab 232 may extend or protrude from first end 242 of handle 18 along the transverse direction T (e.g., when door 16 is in the closed position). In detail, first tab 232 may be provided beneath first outer locating pin 252 along the vertical direction V (e.g., when door 16 is in the closed position). Accordingly, first tab 232 may be aligned with tab opening 224 along the transverse direction T (e.g., when handled 18 is assembled to upper trim piece 220). First tab 232 may protrude a predetermined amount (e.g., length or distance) from handle 18 along the transverse direction T. For instance, a protruding length of first tab 232 may be greater than a thickness (e.g., along the transverse direction T) of upper trim piece 220. Accordingly, at least a portion of first tab 232 may protrude through upper trim piece 220 (e.g., along the transverse direction T).

It should be understood that second tab 234 may be similar to first tab 232. For instance, second tab 234 may be positioned at second end 244 of handle 18. Second tab 234 may be provided beneath second outer locating pin 258 along the vertical direction V (e.g., when door 16 is in the closed position). In other words, second tab 234 may be mirrored about a central axis defined along the vertical direction V through door 16. Accordingly, a protruding length of second tab 234 may be similar to (or the same as) the protruding length of first tab 232 along the transverse direction T.

Figure 5:
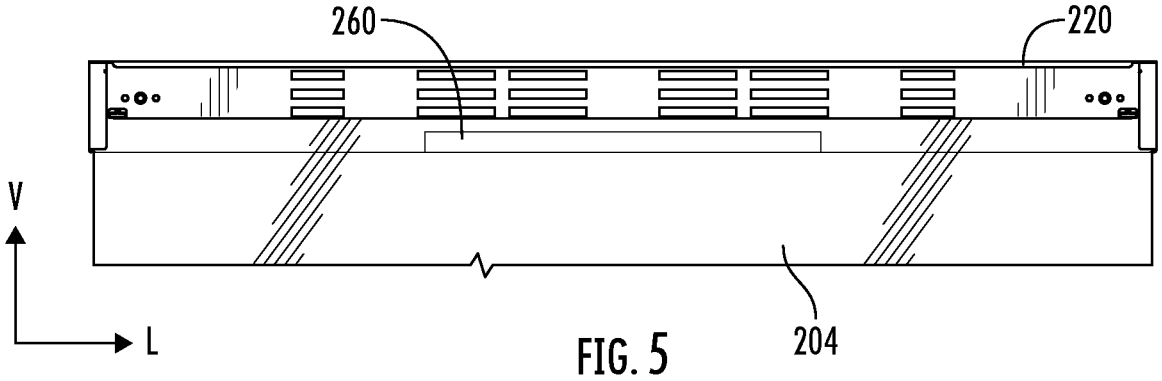
FIG. 5 provides a rear view of a front glass panel provided within a support frame of an oven door according to exemplary embodiments of the present disclosure.
Figure 6:
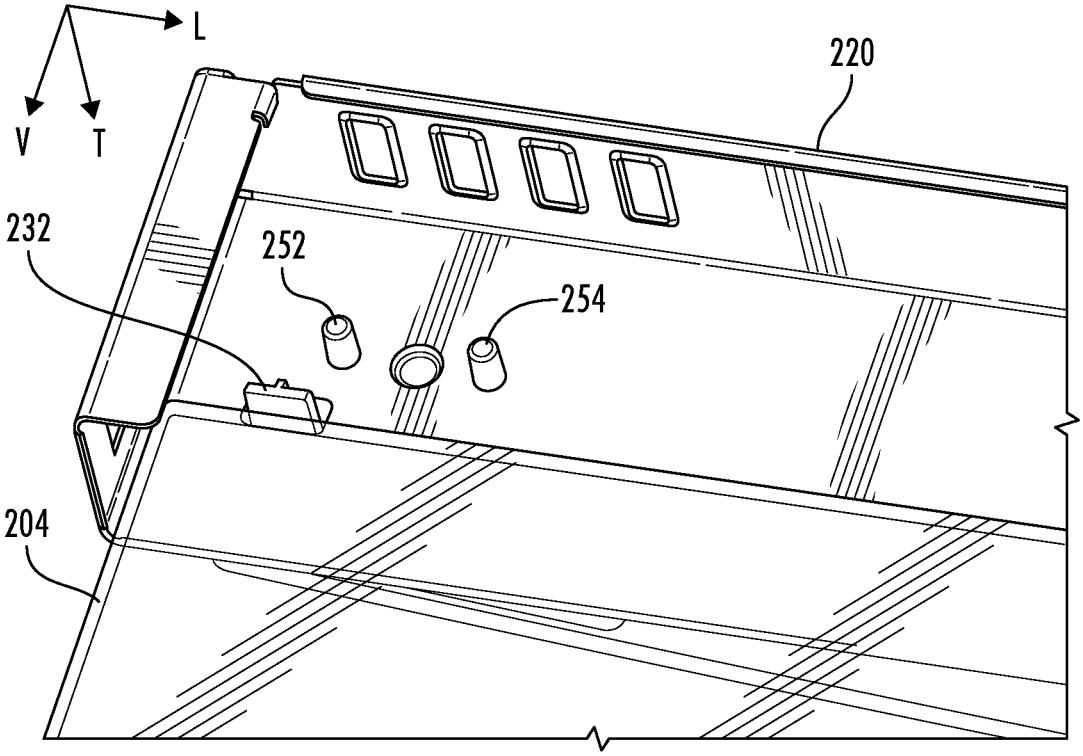
FIG. 6 provides a close up perspective view of a relationship between the door handle, door trim, and front glass panel of the embodiment of FIG. 5.

Front glass panel 204 may be selectively connected with upper trim piece 220. For instance, as shown in FIG. 5, one or more adhesive strips 260 may be provided on upper trim piece 220. The one or more adhesive strips 260 may include a single elongated (e.g., along the lateral direction L) adhesive strip 260 positioned at or near a lateral center of upper trim piece 220. Front glass panel 204 may be located with respect to upper trim piece 220 and pressed onto adhesive strip 260. In detail, as shown particularly in FIG. 6, a top edge 2041 of front glass panel 204 may engage with the pair of tabs 230 (e.g., first tab 232 and second tab 234). During assembly, an assembler may push front glass panel 204 toward the pair of tabs 230 until top edge 2041 contacts each of first tab 232 and second tab 234. Advantageously, at this point, a proper position of front glass panel 204 may be easily ensured and confirmed by the pair of tabs 230. Front glass panel 204 may then be lowered (or rotated) to contact adhesive strip 260.

Figure 7:
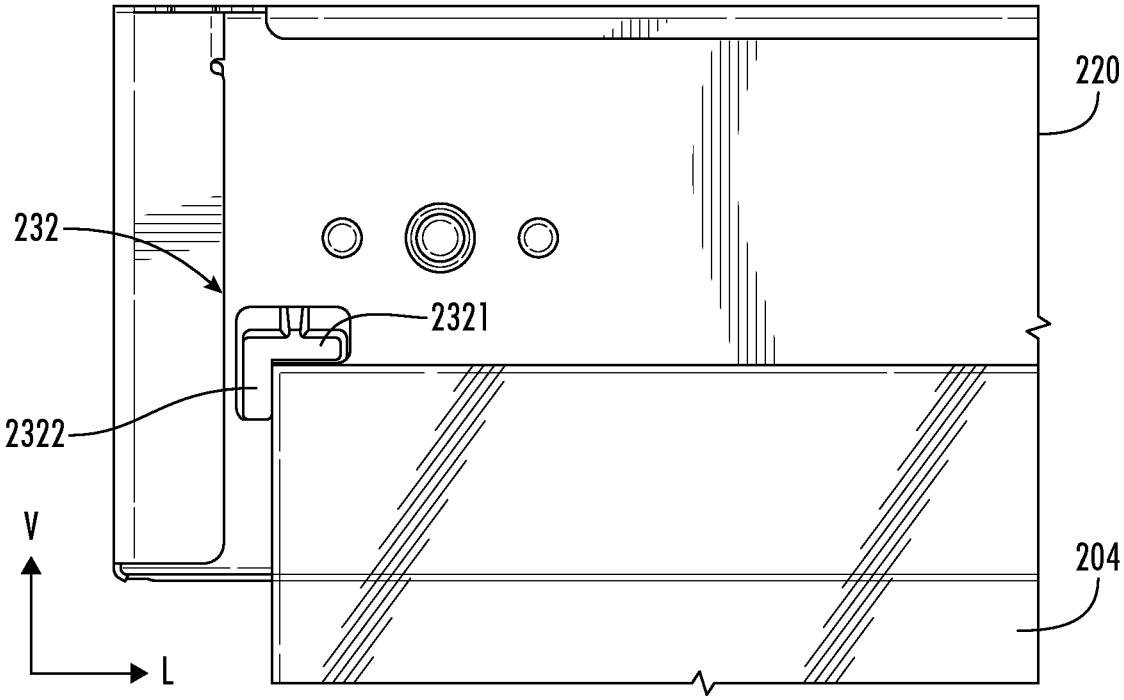
FIG. 7 provides a rear view of a relationship between the door handle, door trim, and front glass panel according to another exemplary embodiment of the present disclosure.

Referring to FIG. 7, another embodiment of the present disclosure is provided. According to the embodiment shown in FIG. 7, each of the pair of tabs 232 is provided in an "L" shape, as will be described. For the sake of brevity, first tab 232 will be described in detail with the understanding that the description applies also to second tab 234 (e.g., in a mirrored fashioned).

According to this embodiment, first tab 232 may include a lateral portion 2321 and a vertical portion 2322. For instance, lateral portion 2321 may extend predominantly along the lateral direction L (e.g., similar to first tab 232 in the embodiment described above). Vertical portion 2322 may extend downward along the vertical direction V (e.g., when door 16 is in the closed position) from lateral portion 2321. Vertical portion 2322 may be disposed at an end of lateral portion 2321. In detail, vertical portion 2322 may be provided at an outer lateral end of lateral portion 2321. In other words, vertical portion 2322 may be positioned toward a lateral edge of support frame 202 (e.g., upper trim piece 220). Thus, lateral portion 2321 and vertical portion 2322 may define an "L" shape facing toward a center of door 16. Advantageously, first tab 232 may be used to locate front glass panel 204 along each of the vertical direction V and the lateral direction L. Likewise, second tab 234 may define an "L" shape facing toward the center of door 16, as would be understood.

Lateral portion 2322 may be spaced apart from the lateral edge of support frame 202. In detail, according to this embodiment, support frame 202 may include a lateral trim piece extending downward along the vertical direction V from upper trim piece 220. Thus, front glass panel 204 may be spaced apart from the lateral side of support frame 202. Accordingly, vertical portion 2322 is provided a predetermined space away from the lateral edge of support frame 202. Similarly, a vertical portion of second tab 234 may be provided a predetermined space away from an opposite lateral edge of support frame 202. Additionally or alternatively, tab opening 224 may include each of a lateral portion and a vertical portion commensurate with (e.g., substantially equal to) lateral portion 2321 and vertical portion 2322, respectively.

Figure 8:
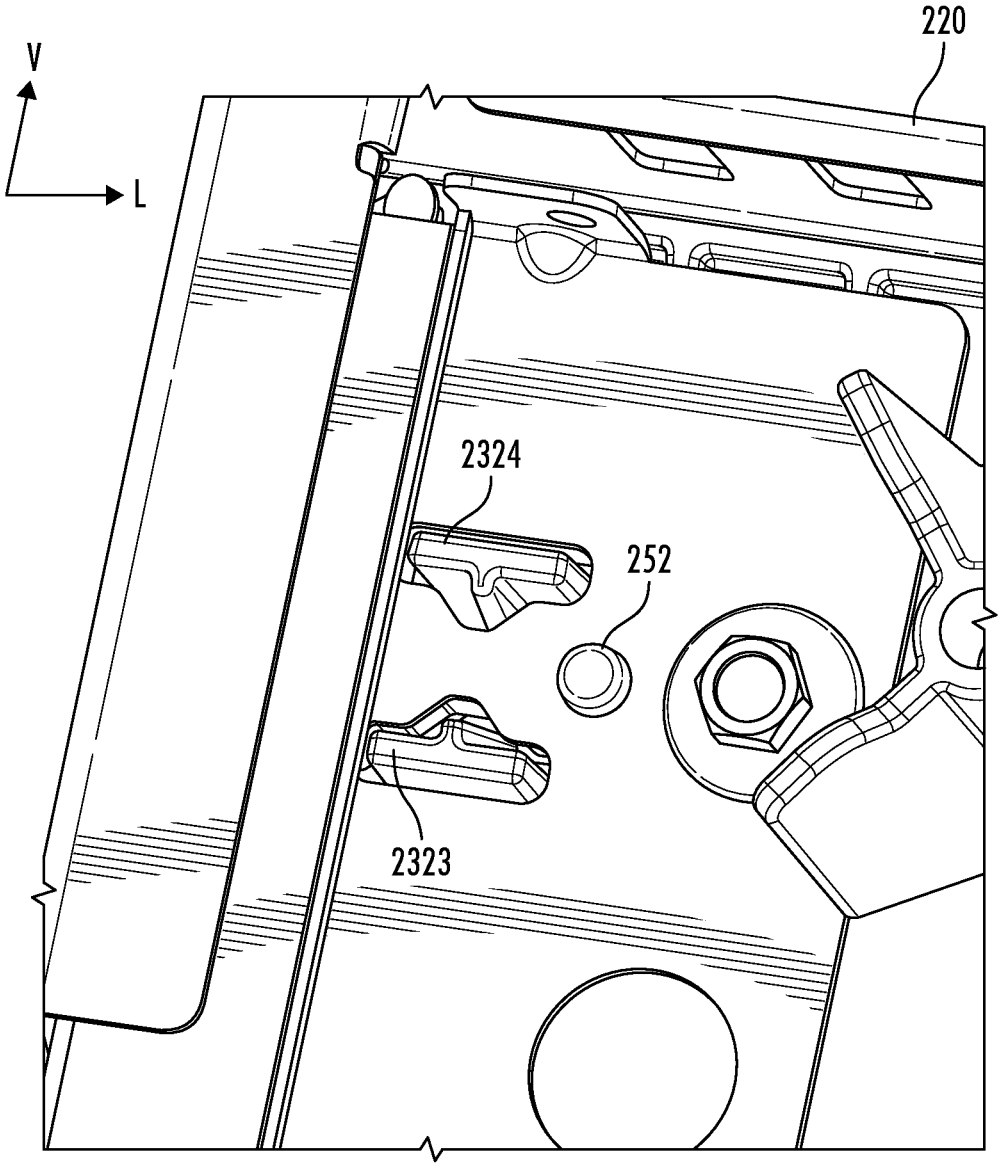
FIG. 8 provides a rear perspective view of a relationship between the door handle, door trim, and front glass panel according to another exemplary embodiment of the present disclosure.

Referring to FIG. 8, yet another embodiment of the present disclosure is provided. According to the embodiment shown in FIG. 8, two first tabs 232 are provided (e.g., a lower tab 2323 and an upper tab 2324), as will be described. In some cases, lower tab 2323 is first tab 232 and upper tab 2324 is second tab 234, and each are provided on a single endcap 184 (e.g., such that first endcap 184 and second endcap 186 are identical and may be interchanged during assembly).

As described above, lower tab 2323 is provided beneath first outer locating pin 252 (e.g., along the vertical direction V when door 16 is in the closed position). According to the embodiment shown in FIG. 8, upper tab 2324 may extend from handle 18 (or first endcap 184) generally parallel with lower tab 2323. Upper tab 2324 may thus be positioned above first outer locating pin 252 (e.g., along the vertical direction V when door 16 is in the closed position). Upper tab 2324 may be generally similar to lower tab 2323 mirrored about an axis defined along the lateral direction L. For instance, upper tab 2324 may be parallel with lower tab 2323 along the transverse direction T. Moreover, as would be understood, an additional tab opening may be defined through upper trim piece 220 (e.g., along the transverse direction T) above the outer opening 226, through which upper tab 2324 may protrude. Advantageously, a single endcap may be used during assembly, which may help to prevent misplacement of endcaps.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A door assembly for a domestic appliance, the domestic appliance defining a vertical direction, a lateral direction, and a transverse direction and comprising a cabinet forming a receiving space, the door assembly comprising:

a support frame comprising at least one trim piece directed away from the receiving space along the transverse direction;

a front glass panel selectively mounted to the support frame between the at least one trim piece and the receiving space, the front glass panel comprising a top edge; and a handle assembly attached to the at least one trim piece opposite the front glass panel, the handle assembly comprising a pair of tabs protruding through the at least one trim piece toward the receiving space along the transverse direction, wherein the pair of tabs engage the top edge of the front glass panel along the vertical direction.

2. The door assembly of claim 1, wherein the handle assembly further comprises:

a first endcap provided at a first lateral end; and a second endcap provided at a second lateral end opposite the first lateral end along the lateral direction.

3. The door assembly of claim 2, wherein the pair of tabs comprises:

a first tab protruding from the first endcap through the at least one trim piece; and a second tab protruding from the second endcap through the at least one trim piece.

4. The door assembly of claim 3, wherein the first endcap comprises:

a first pair of locating pins protruding along the transverse direction parallel with the first tab, wherein the first tab is positioned below the pair of locating pins along the vertical direction, and wherein the second endcap comprises:

a second pair of locating pins protruding along the transverse direction parallel with the second tab, wherein the second tab is positioned below the pair of locating pins along the vertical direction.

5. The door assembly of claim 4, wherein the first tab is a lower tab, and wherein the first endcap comprises an upper tab spaced apart from the lower tab along the vertical direction, the upper tab being parallel with the lower tab along the transverse direction.

6. The door assembly of claim 5, wherein the upper tab is positioned above the pair of locating pins along the vertical direction.

7. The door assembly of claim 3, wherein the first tab comprises:

a lateral portion extending along the lateral direction; and a vertical portion extending from the lateral portion downward along the vertical direction to define an "L" shape, the vertical portion being positioned toward a lateral edge of the support frame.

8. The door assembly of claim 7, wherein the vertical portion of the first tab is spaced apart from the lateral edge of the support frame by a predetermined distance.

9. The door assembly of claim 1, wherein the at least one trim piece is an upper trim piece provided at a top of the support frame along the vertical direction.

10. An oven appliance defining a vertical direction, a lateral direction, and a transverse direction, the oven appliance comprising:

a cabinet defining a cooking chamber; and a door assembly movably mounted to the cabinet to selectively provide access to the cooking chamber, the door assembly comprising:

a support frame comprising at least one trim piece directed away from the cooking chamber along the transverse direction;

a front glass panel selectively mounted to the support frame between the at least one trim piece and the cooking chamber, the front glass panel comprising a top edge; and a handle assembly attached to the at least one trim piece opposite the front glass panel, the handle assembly comprising a pair of tabs protruding through the at least one trim piece toward the cooking chamber along the transverse direction, wherein the pair of tabs engage the top edge of the front glass panel along the vertical direction.

11. The oven appliance of claim 10, wherein the handle assembly further comprises:

a first endcap provided at a first lateral end; and a second endcap provided at a second lateral end opposite the first lateral end along the lateral direction.

12. The oven appliance of claim 11, wherein the pair of tabs comprises:

a first tab protruding from the first endcap through the at least one trim piece; and a second tab protruding from the second endcap through the at least one trim piece.

13. The oven appliance of claim 12, wherein the first endcap comprises:

a first pair of locating pins protruding along the transverse direction parallel with the first tab, wherein the first tab is positioned below the pair of locating pins along the vertical direction, and wherein the second endcap comprises:

a second pair of locating pins protruding along the transverse direction parallel with the second tab, wherein the second tab is positioned below the pair of locating pins along the vertical direction.

14. The oven appliance of claim 13, wherein the first tab is a lower tab, and wherein the first endcap comprises an upper tab spaced apart from the lower tab along the vertical direction, the upper tab being parallel with the lower tab along the transverse direction.

15. The oven appliance of claim 14, wherein the upper tab is positioned above the pair of locating pins along the vertical direction.

16. The oven appliance of claim 12, wherein the first tab comprises:

a lateral portion extending along the lateral direction; and a vertical portion extending from the lateral portion downward along the vertical direction to define an "L" shape, the vertical portion being positioned toward a lateral edge of the support frame.

17. The oven appliance of claim 16, wherein the vertical portion of the first tab is spaced apart from the lateral edge of the support frame by a predetermined distance.

18. The oven appliance of claim 10, wherein the at least one trim piece is an upper trim piece provided at a top of the support frame along the vertical direction.

19. The door assembly of claim 9, wherein one or more adhesive strips are provided on the upper trim piece to selectively connect the front glass panel to the upper trim piece.

20. The door assembly of claim 18, wherein one or more adhesive strips are provided on the upper trim piece to selectively connect the front glass panel to the upper trim piece.

* * * * *